US005321419A

United States Patent [19]

Katakura et al.

[11] Patent Number: 5,321,419

[45] Date of Patent: Jun. 14, 1994

[54] DISPLAY APPARATUS HAVING BOTH REFRESH-SCAN AND PARTIAL-SCAN

[75] Inventors: Kazunori Katakura; Yoshio Hotta; Akira Tsuboyama, all of Atsugi; Mitsuo Iwayama, Odawara; Tadashi Mihara, Isehara, all of Japan

[73] Assignee: Canon Kabushiki Kaisha, Tokyo, Japan

[21] Appl. No.: 899,720

[22] Filed: Jun. 17, 1992

[30] Foreign Application Priority Data

Jun. 18, 1991 [JP] Japan ..... 3-145996
May 11, 1992 [JP] Japan ..... 4-117607

[51] Int. Cl.[5] ..... G09G 3/36

[52] U.S. Cl. ..... 345/97; 345/95

[58] Field of Search ..... 340/784, 811; 345/94, 345/95, 97

[56] References Cited

U.S. PATENT DOCUMENTS 4,655,561 4/1987 Kanbe et al. .
4,691,200 9/1987 Stephany ..... 340/784
4,898,456 2/1990 Okada et al. .
4,902,107 2/1990 Tsuboyama et al. .
5,026,144 6/1991 Taniguchi et al. .
5,033,822 7/1991 Ooki et al. .
5,058,994 10/1991 Mihara et al. .
5,091,723 2/1992 Kanno et al. ..... 340/811
5,124,820 6/1992 Tsuboyama et al. .
5,136,282 8/1992 Inaba et al. ..... 345/97

FOREIGN PATENT DOCUMENTS 0066983 12/1982 European Pat. Off. .
0197742 10/1986 European Pat. Off. .
0272079 6/1988 European Pat. Off. .
0361471 4/1990 European Pat. Off. .
0394903 10/1990 European Pat. Off. .
0416172 3/1991 European Pat. Off. .
62-287172 12/1987 Japan .

OTHER PUBLICATIONS

Pat. Abs. Jp., vol. 14, No. 66, Feb. 7, 1990 (JP-A-01288830).

*Primary Examiner*—Jeffery Brier
*Attorney, Agent, or Firm*—Fitzpatrick, Cella Harper & Scinto

[57] ABSTRACT

A display apparatus includes a matrix of electrodes formed of scanning electrodes and information electrodes. A scanning device uses a plurality of scanning methods for selecting scanning electrodes and performs the scanning methods according to respective priorities, and a driving device changes driving conditions according to the scanning methods or the priorities thereof.

9 Claims, 16 Drawing Sheets

DISPLAY APPARATUS HAVING BOTH REFRESH-SCAN AND PARTIAL-SCAN

BACKGROUND OF THE INVENTION

1. Field of the Invention

The present invention relates to a display apparatus employing matrix electrodes and, more particularly, to a liquid crystal display apparatus which employs ferroelectric liquid crystal and performs scanning for partial rewriting.

2. Description of the Related Art

A liquid crystal display device for displaying image information is known which comprises many pixels formed by placing a liquid crystal compound between an array of scanning electrodes and an array of signal electrodes to constitutes a matrix of electrodes. An example of this type of display device is illustrated in Figs, 15 and 16. A scanning method used in such a display device is disclosed, for example, in U.S. Pat. No. 4,655,561 (Kanbe et al.) and in U.S. Ser. No. 85,017 (Inoue et al., Aug. 13, 1987). The method utilizes a memory to scan for partial rewriting so as to maintain a smooth display of movements even during low field frequency scanning.

Another driving waveform is disclosed by Taniguchi et al. in European Laid-Open No. 394,903, which helps to speed up the frame frequency and provide a sufficient driving margin, i.e., the range of the driving voltage or the writing pulse width within which images of favorable quality can be displayed.

However, since the scanning waveform according to the above conventional art is a black erasing waveform and includes DC components, frequent repetition of partial-rewrite scanning on a single scanning electrode causes the following problems in the pixels on that scanning electrode.

(1) decrease of the driving margin (2) deterioration of liquid crystal alignment (3) decrease in sharpness of contrast

SUMMARY OF THE INVENTION

It is an object of the present invention to provide a display apparatus which solves the above problems. To substantially avoid a decrease of the driving margin, deterioration of liquid crystal alignment and decrease in sharpness of contrast which are caused during partial-rewrite scanning, a display apparatus according to the present invention comprises a matrix of electrodes including scanning electrodes and information electrodes, scanning means for scanning the matrix and operable in any one of a plurality of scanning methods having respective driving conditions and respective priorities assigned thereto, the scanning means scanning the matrix by selecting ones of the scanning electrodes in accordance with selected ones of the scanning methods, and driving means for applying driving signals to the selected scanning electrodes in accordance with the driving conditions and priorities of the selected driving methods.

Further objects, features and advantages of the present invention will become apparent from the following description of the preferred embodiments with reference to the attached drawings.

DESCRIPTION OF THE PREFERRED EMBODIMENTS

Operation of a display apparatus according to one embodiment of the present invention will be described hereinafter with reference to the figures.

Figure 1:
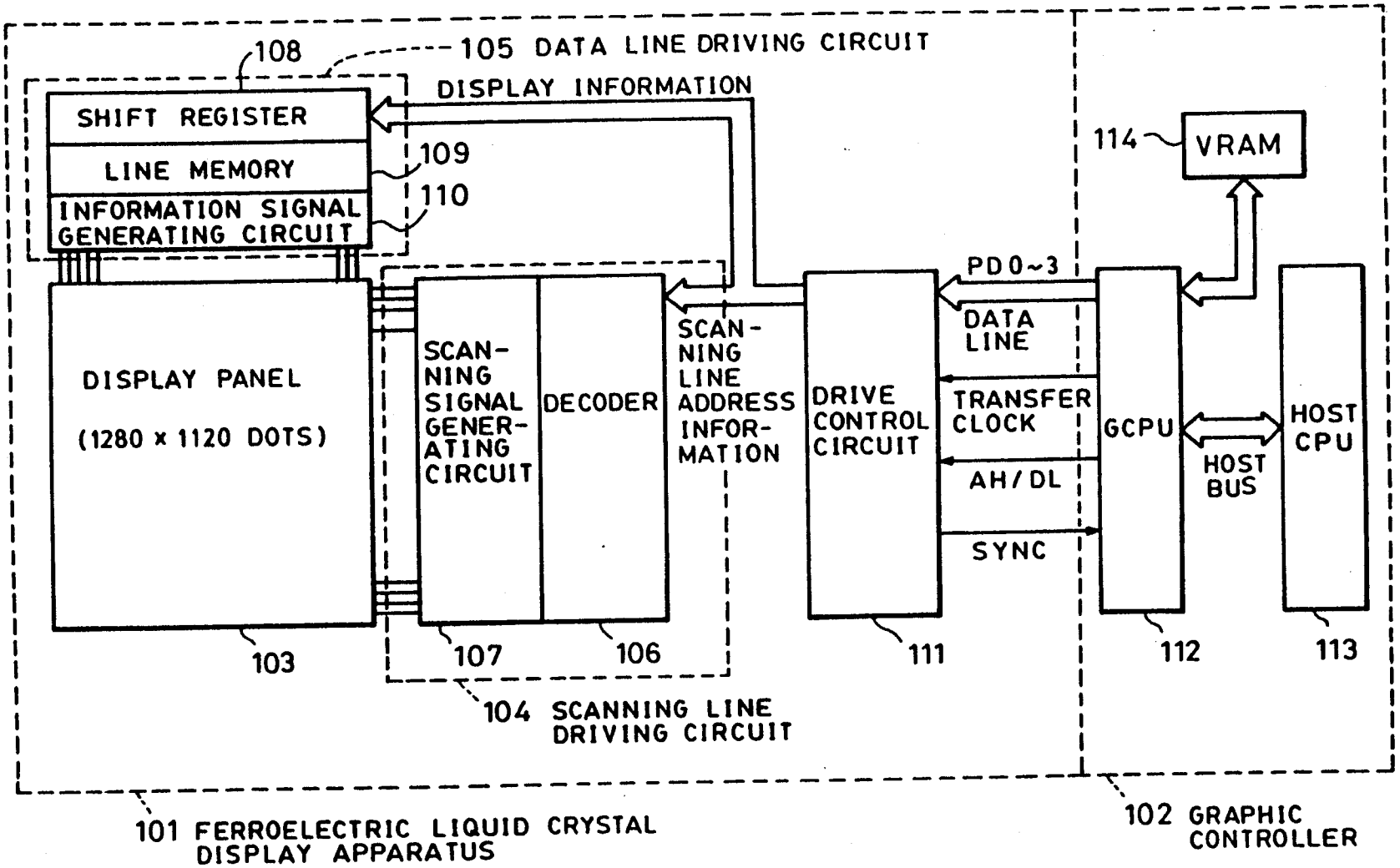
FIG. 1 is a block diagram of a liquid crystal display apparatus and a graphic controller.
Figure 2:
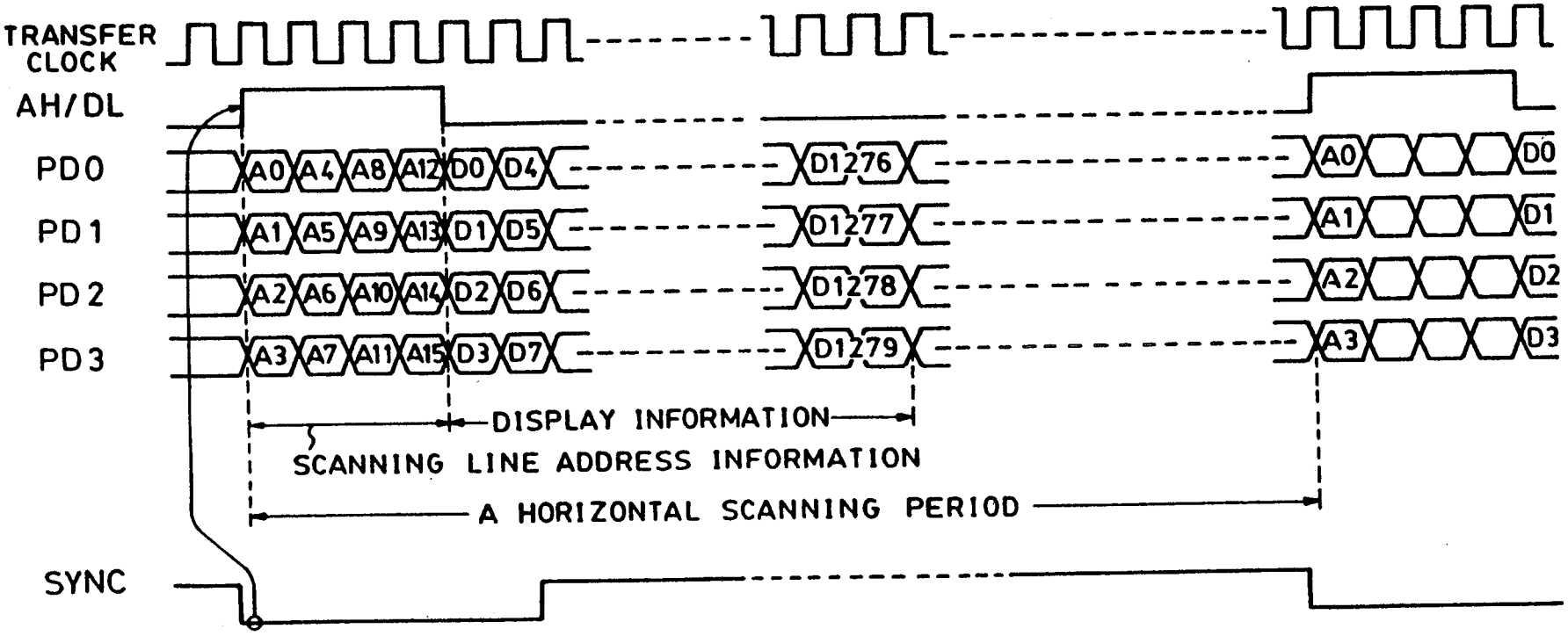
FIG. 2 is a timing chart of image information communication between the liquid crystal display apparatus and the graphic controller of FIG. 1.

Referring to FIGS. 1 and 2, a graphic controller 102 transfers scanning line address information for designating scanning electrodes and image data (PD0 to PD3) for the scanning lines designated by the scanning line address information to a display driving circuit 104/105 (composed of a scanning line driving circuit 104 and a data line driving circuit 105) of a liquid crystal display apparatus 101, which advantageously includes a ferroelectric liquid crystal. In this embodiment, because image data including both scanning line address information and display information are transferred through one communication line, the two kinds of information must be discriminated. Signal AH/DL is used to perform this discrimination, so that a high level of the AH/DL signal indicates scanning line address information, and a low level of the AH/DL signal indicates display information.

Scanning line address information is extracted from the image data PD0 to PD3 by a drive control circuit 111 of the liquid crystal display apparatus 101 and then outputted to the scanning line driving circuit 104 at a timing for driving the designated scanning lines. The scanning line address information is inputted into a decoder 106 in the scanning line driving circuit 104. In response to signals from the decoder 106, a scanning signal generating circuit 107 drives the designated scanning electrodes of the display panel 103.

On the other hand, display information is fed to a shift register 108 of the data line driving circuit 105. The shift register 108 shifts the display information in units of four bits using a transfer clock. When the shift register 108 has shifted the display information of one horizontal scanning line, the display information of 1280 pixels is transferred to a line memory 109 connected to the shift register 108. The display information is stored in the line memory 109 for a period equal to one horizontal line scanning period and then outputted as display information signals from the information signal generating circuit 110 to the associated information electrodes.

Because the driving of the display panel 103 in the liquid crystal display apparatus 101 is not synchronous with generation of scanning line address information and display information in the graphic controller 102 according to this embodiment, the liquid crystal display apparatus 101 and the graphic controller 102 must be synchronized with each other when image data is transferred, by using a SYNC signal. The SYNC signal is generated by the drive control circuit 111 of the liquid crystal display apparatus 101 for each horizontal scanning period. The graphic controller 102 always monitors SYNC signals. When a SYNC signal is at low level, the graphic controller 102 transfers picture data. When a SYNC signal is at high level, the graphic controller 102 does not continue to transfer image data after transferring image data of one horizontal scanning line. Referring to FIG. 2, as soon as the graphic controller 102 detects the low level of the SYNC signal, the graphic controller 102 changes the AH/DL signal to high level in order to start transferring image data of one horizontal scanning line. The drive control circuit 111 of the liquid crystal display apparatus 101 changes the SYNC signal to high level while image data is being transferred. After one horizontal scanning period, i.e., after data-writing into one horizontal scanning line of the display panel 103 is completed, the drive controller circuit (FLCD controller) 111 changes the SYNC signal back to low level to enable the reception of image data for the next scanning line.

Figure 3:
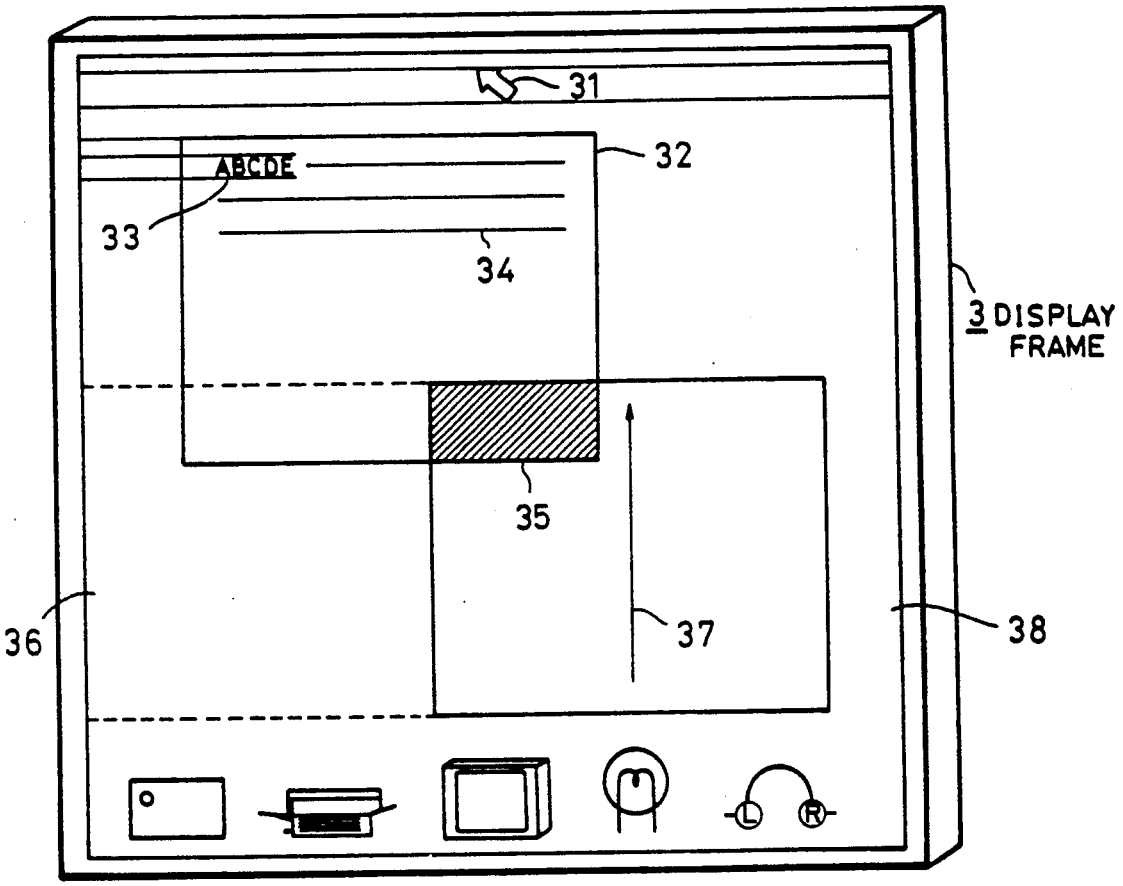
FIG. 3 illustrates a display frame including a plurality of graphic events.

FIG. 3 illustrates a display frame 3 when the following display requests for display information are made in multiwindow and multitask format:

- display request 31 to smoothly move a mouse diagonally;
- display request 32 to display a portion of a window selected as the active frame, which portion is overlapped by a previously selected window;
- display request 33 to insert characters by key-board input;
- display request 34 to move characters already displayed (in a direction indicated by arrow keys);
- display request 35 for display change in an overlap area;
- display request 36 to display a non-active window;
- display request 37 to perform scrolling in a non-active window; and The following Table 1 shows the respective priorities of graphic events corresponding to the above display requests 31 to 38.

TABLE 1

| Graphic Event | Drive Mode | Display Priority | Description |
|---|---|---|---|
| 31 Mouse Movement Display | Partial Rewrite | Highest | |
| 32 Active Window Area On | | | Logical Access Area |
| 33 Character Insertion Display | Partial Rewrite | 2nd Level | |

TABLE 1-continued

| Graphic Event | Drive Mode | Display Priority | Description |
|---|---|---|---|
| 34 Character Movement Display | Partial Rewrite | 3rd Level | |
| 35 Overlap area Display change | | | Logical VRAM Operation |
| 36 Non-active Window Area On | | | Logical Access Area |
| 37 Non-active Window Area Scroll Display | Partial Rewrite | 4th Level | |
| 38 Entire Scanning Display | Multi-field Refresh | Lowest | |

In the above table: "Partial Rewrite" means a driving method which scans only the scanning lines in a partial rewriting area; "Multi-field Refresh" means an entire-frame scanning mode using multi-interlace scanning of N-fields ($N=2, 4, 8, \ldots 2^n$) (a driving method described in Japanese patent application No. 62-287172); "Display Priority" means the priorities assigned to the events beforehand; and "Description" means an internal description operation performed in a graphic processor. In this embodiment, the priorities of the events are determined according to operability in a man/machine interface. The top priority is given to the graphic event 31 (mouse movement display), and is followed in descending order by the graphic events 33, 34, 37 and 38.

The mouse movement display is given the top priority because operator's intention expressed by moving the pointing device, i.e., the mouse, should be reflected in the computer as quickly as possible, i.e., in real time. Character input through the key board comes next. Although such key input requires a quite high real-time characteristic, the key input is usually buffered and, therefore, does not require as high a real-time characteristic as the mouse movement display. Frame renewal (scrolling) in the window does not need to be performed simultaneously with the key input, and the document line to which characters are inputted has a higher priority than frame renewal. The display manner of an overlap area in a case where scrolling is performed in an overlapped window varies according to system setting. According to this embodiment, document-line scrolling in the overlapped window goes beneath the active window.

Figure 4:
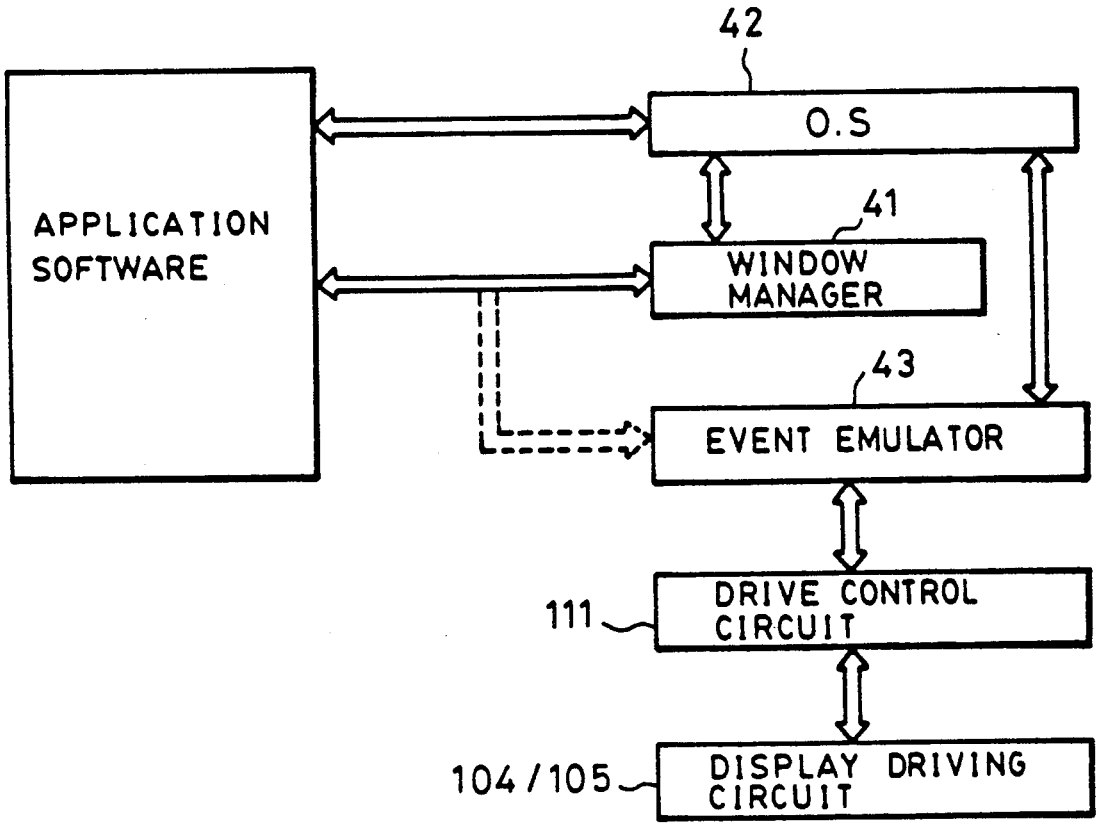
FIG. 4 is a block diagram of a display control program used in the present invention.

According to the present invention, a frame display control method illustrated in FIG. 4 receives the external display requests 31 to 38 through communication means including a window manager 41 and an operating system (OS) 42 and then transfers the requests to the ferroelectric liquid crystal display apparatus (FLCD) 101. If at least one request is made to rewrite information currently displayed, the frame display control program, according to the display priority of the request, determines the area to be rewritten and the necessary description of data in the VRAM (an image data memory) and selects image data to send to the FLCD 101 while synchronizing the graphic controller 102 and the display apparatus 101.

The OS 42 of the communication means may be MS-DOS (trademark), or XENIX (trademark) of Microsoft in the USA, OS/2 (trademark) of IBM Corp. in the USA, or UNIX (trademark) of AT&T in the USA. The window manager 41 may be MS-Windows ver. 1.03 or ver. 2.0 (trademarks) of Microsoft in the USA, OS/2 Presentation Manager (trademark) of IBM Corp. in the USA, public domain X-Window, or DEC-Window (trademark) of Digital Equipment in the USA. An event emulator 43 may be a pair of MS-DOS and MS-Windows or a pair of UNIX and X-Window.

Partial rewriting according to the present invention is performed by scanning only the scanning lines in a partial rewriting area. Since the FLCD 101 has a memory, partial rewriting can be performed at high speed. Also, according to the present invention, it is supposed that, at any particular moment, there will not be many events in which the computer system has to rewrite display information at high speed. For example, information from the pointing device (a mouse, etc.) can be sufficiently displayed at a speed of 30 Hz or less because display at a greater speed can not be followed by the human eye. Also, the speed of smooth scrolling (scrolling in units of a scanning line), which is required to be greater than that of any other display, must stay in a certain range for the same reason. In practice, scrolling is often performed in units of a character or a block instead of a scanning line. Scrolling in a computer system is usually performed in order to edit a program or a document, in which case what counts is not smooth scrolling but rather quick shifting from one document line to another (document-line scrolling in units of a document line). A display speed of 10 document lines per second is sufficient for document-line scrolling.

If partial rewrite scanning in the FLCD 101 is performed by a non-interlace method in order to display movement of a mouse formed in 32×32 dots, the following response speed is possible.

[Calculation 1] 32 lines × 100 μsec/line = 3.2 msec ≈ 312 Hz

The document-line scrolling at a speed of 10 document lines per second corresponds to frame renewal at 10 Hz by the non-interlace method. Flickering caused by the frame frequency of 10 Hz does not become a problem because the operator's attention is more strongly drawn to display changes caused by the document-line scrolling. The number of scanning lines driven by the non-interlace method during document-line scrolling is

[Calculation 2] (1/10 Hz)/100 μsec = 1000 (scanning lines)

The display apparatus of the present invention employs a data format, i.e., image data including scanning line address information, and communication synchronizing means using the SYNC signal, as shown in FIGS. 1 and 2, so as to be driven according to a partial rewrite scanning method performed by the graphic controller, as described below.

Image data is generated by the graphic controller 102 of the apparatus according to the invention and transferred to the display panel 103 by the signal transferring means shown in FIGS. 1 and 2. The graphic controller 102 has a CPU (a central processing unit, referred to as a "GCPU" hereinafter) 112 and a VRAM (an image data memory) 114, which together control management and communication of image data between a host CPU 113 and the liquid crystal display apparatus 102. The graphic controller 102 plays a primary role in performing the control method according to the present invention.

Figure 10:
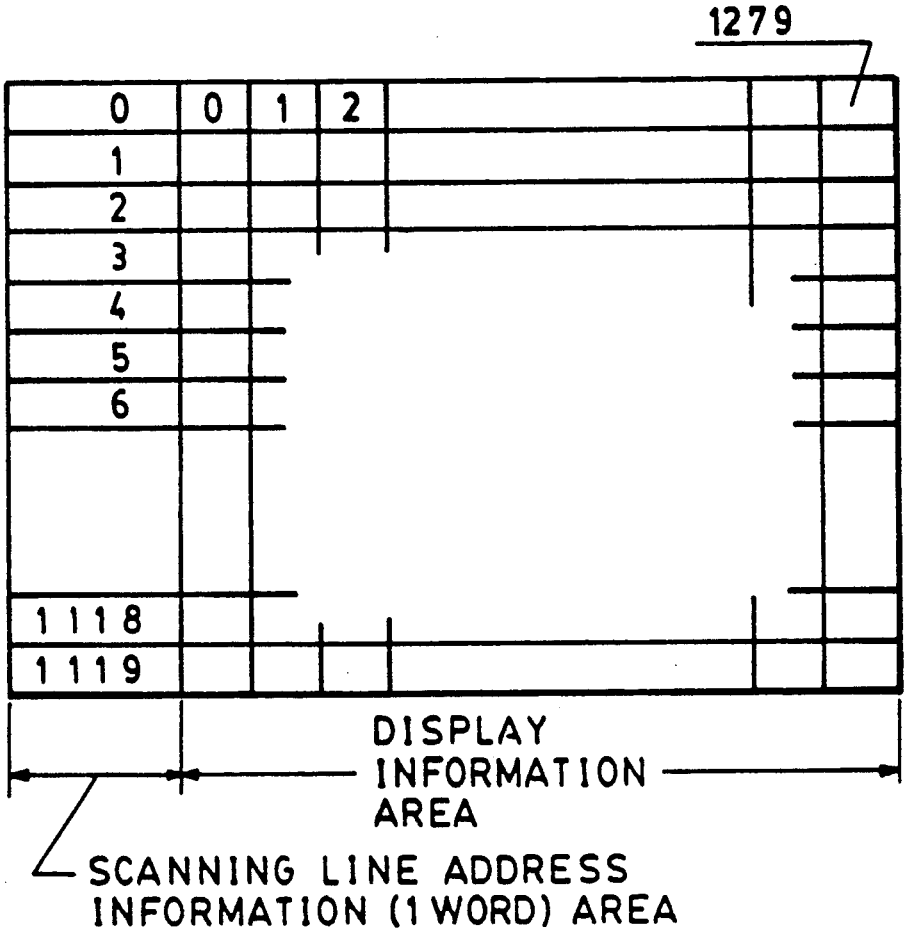
FIG. 10 illustrates data mapping of scanning line address information and display information on a VRAM used in the present invention.

To obtain this data format, i.e., image data including scanning line address information, the scanning line address information is mapped in the VRAM 114 as shown in FIG. 10. The VRAM 114 is divided into two areas: one area assigned for scanning line address information and the other area assigned for display information. Image data of one scanning line are lined up horizontally and scanning line address information is placed on the leading end (the left end in FIG. 10) of the thus lined-up image data of each scanning line. As a result, the data mapped in the VRAM 114 correspond, on a one-to-one basis, to the pixels of the display panel 103. The GCPU 112 reads out the image data of one line at a time from the left end in the VRAM 114 and sends out the read-out data to the liquid crystal display apparatus 101 so as to achieve the data format, i.e., image data including scanning line address information as well as display information.

Figure 9:
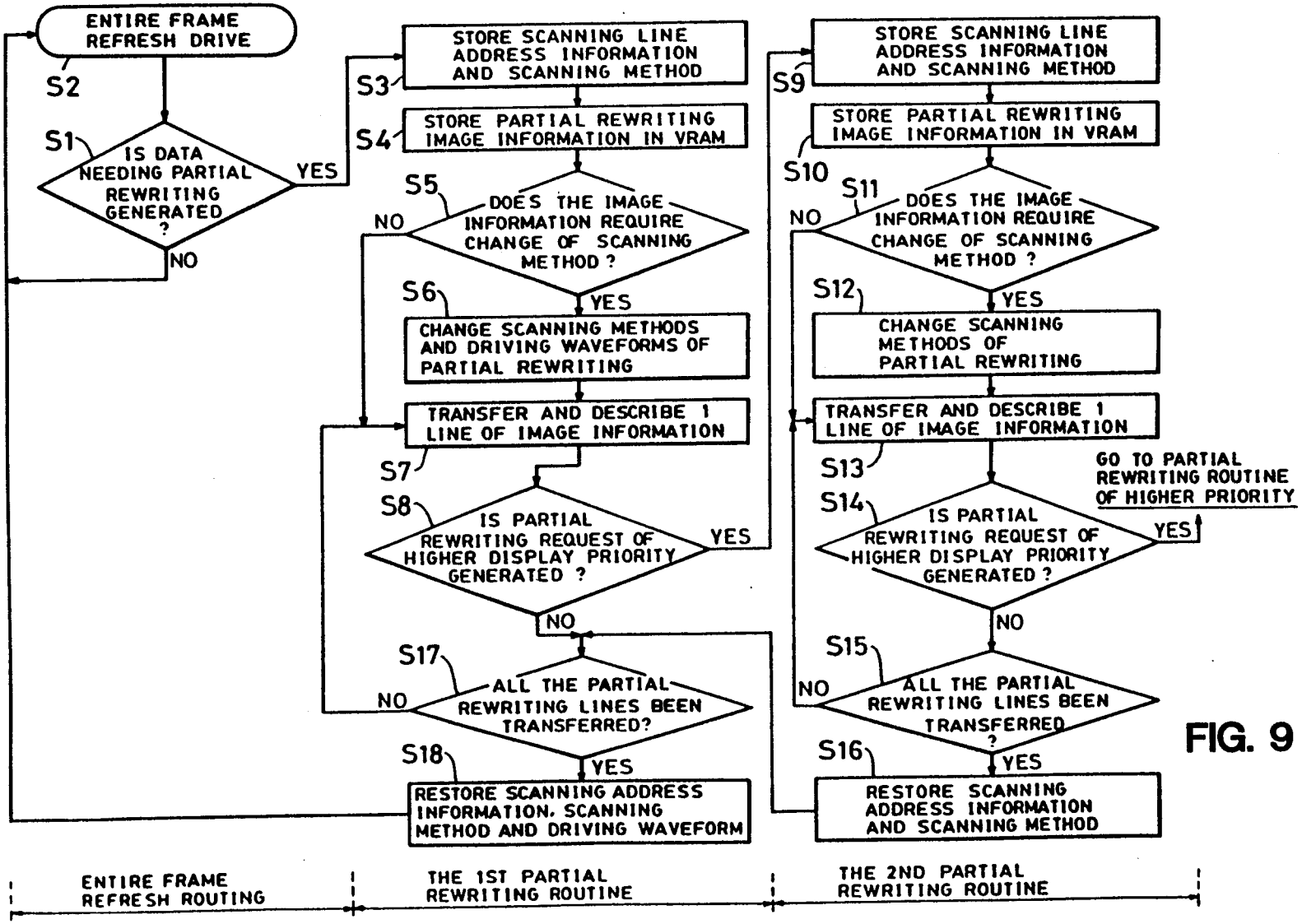
FIG. 9 illustrates a method for partial rewriting used in the present invention.

FIG. 9 shows a method for partial rewriting according to one embodiment of the present invention. In this embodiment, if there is no request for partial rewriting (S1), an entire frame is scanned by the multi-interlace method (entire frame refresh driving) (S2). The image data (data about the pointing device, the pop-up menu, etc.) necessary for the ferroelectric liquid crystal display apparatus 101 to perform partial rewriting is registered beforehand in the GCPU 112 and the method branches to partial rewriting according to information from the host CPU 113. Immediately before branching to partial rewriting, the data about the address of the scanning line being currently scanned, the number of scanning lines and the current scanning method (a non-interlace method or a multi-interlace method, and in the case of multi-interlace method, the number of fields composing one frame) is saved (S3) in a register preassigned therefor in the GCPU 112 so that processing can return to the normal refresh routine after the partial rewriting routine is completed. Then, the image data for the partial rewriting is developed in the VRAM 114 (S4). The host CPU 113 is allowed to access to the VRAM 114 solely via the GCPU 112. The GCPU 112 manages the area and the starting address in the VRAM 114 to store image data for partial rewriting.

After the image data is stored in the VRAM 114, transfer of the image data to the liquid crystal display apparatus 101 is started. For this transfer, the GCPU 112 changes scanning methods from multi-interlace scanning to non-interlace scanning according to the image data for partial rewriting (S5, S6). Scanning methods can be changed simply by changing the sequence for reading out image data including scanning line address information from the VRAM 114 shown in FIG. 10. For example, to perform multi-interlace scanning in which eight fields form one frame, lines of image data in the VRAM 114 are read out every eight lines. To perform non-interlace scanning, the lines of image data are read out one after another in their address order. The image data is transferred to the liquid crystal display apparatus (S7), according to the signal transferring method shown in FIGS. 1 and 2. The scanning line address information mapped in the VRAM 114 is transferred line by line, always monitored by the GCPU 112. Scanning methods are not changed during transfer of image data for partial rewriting.

To handle a second request for partial rewriting generated during processing of partial rewriting, the method checks (S8) whether there is a second request for partial rewriting having a high priority than the partial rewriting being currently processed every time one line of image data has been transferred. If there is a second request for partial rewriting having a higher priority, the transfer of the current (first) partial rewriting image data is stopped, and processing branches to the routine for the second partial rewriting (S9). In the routine for the second partial rewriting, first, the data about the scanning method for the first partial rewriting is stored. Then, the scanning method is changed to a scanning method according to the image data for the second partial rewriting, and processing similar to that in the routine for the first partial rewriting is performed (S10–S15). Finally, the scanning method for the first partial rewriting is restored to return to the routine for the first partial rewriting (S16). Back in the routine for the first partial rewriting, the remaining image data is transferred (S17) while the method checks for generation of another request for partial rewriting of a higher priority after each process of transferring one line of image data. When all the image data is transferred, processing returns to the normal entire refresh routine based on the pre-saved data about the scanning line address, the number of scanning lines and the scanning method (18).

Table 2 below shows the correspondence between the scanning electrode numbers. (the scanning electrodes are numbered from the top scanning electrode to the bottom scanning electrode in the display panel as 1°, 2°, 3°, . . . N°) and the priorities to select scanning methods and scanning electrodes.

TABLE 2

| Scanning Electrode No. | 1° | 2° | 3° | 4° | 5° | 6° | 7° | 8° | 9° |
|---|---|---|---|---|---|---|---|---|---|
| Writing Scanning Method | Priorities to Select Electrodes | | | | | | | | |
| Entire Frame Non-interlace Scanning | 1 | 2 | 3 | 4 | 5 | 6 | 7 | 8 | 9 |
| Entire Frame Interlace Scanning | 1 | 1 + N/2 | 2 | 2 + N/2 | 3 | 3 + N/2 | 4 | 4 + N/2 | 5 |
| Entire Frame Multi-interlace 3 Field Scanning (skipping 2 lines) | 1 | 1 + N/3 | 1 + 2N/3 | 2 | 2 + N/3 | 2 + 2N/3 | 3 | 3 + N/3 | 3 + 2N/3 |
| Entire Frame Multi-interlace 4 Field Scanning (skipping 3 lines) | 1 | 1 + N/4 | 1 + 2N/4 | 1 + 3N/4 | 2 | 2 + N/4 | 2 + 2N/4 | 2 + 3N/4 | 3 |
| Entire Frame Multi-interlace 9 Field Scanning (skipping 8 lines) | 1 | 1 + N/9 | 1 + 2N/9 | 1 + 3N/9 | 1 + 4N/9 | 1 + 5N/9 | 1 + 6N/9 | 1 + 7N/9 | 1 + 8N/9 |
| Partial Rewriting by Non-interlace Scanning | — | — | — | — | 1 | 2 | 3 | 4 | 5 |

| Scanning Electrode No. | 10° | 11° | 12° | ... | N° |
|---|---|---|---|---|---|
| Writing Scanning Method | Priorities to Select Electrodes | | | | |
| Entire Frame Non-interlace Scanning | 10 | 11 | 12 | . . . | N |
| Entire Frame Interlace Scanning | 5 + N/2 | 6 | 6 + N/2 | . . . | N |
| Entire Frame Multi-interlace 3 Field Scanning (skipping 2 lines) | 4 | 4 + N/3 | 4 + 2N/3 | . . . | N |
| Entire Frame Multi-interlace 4 Field Scanning (skipping 3 lines) | 3 + N/4 | 3 + 2N/4 | 3 + 3N/4 | . . . | N |
| Entire Frame Multi-interlace 9 Field Scanning (skipping 8 lines) | 2 | 2 + N/9 | 2 + 2N/9 | . . . | N |
| Partial Rewriting by Non-interlace Scanning | 6 | 7 | — | — | — |

Figure 11:
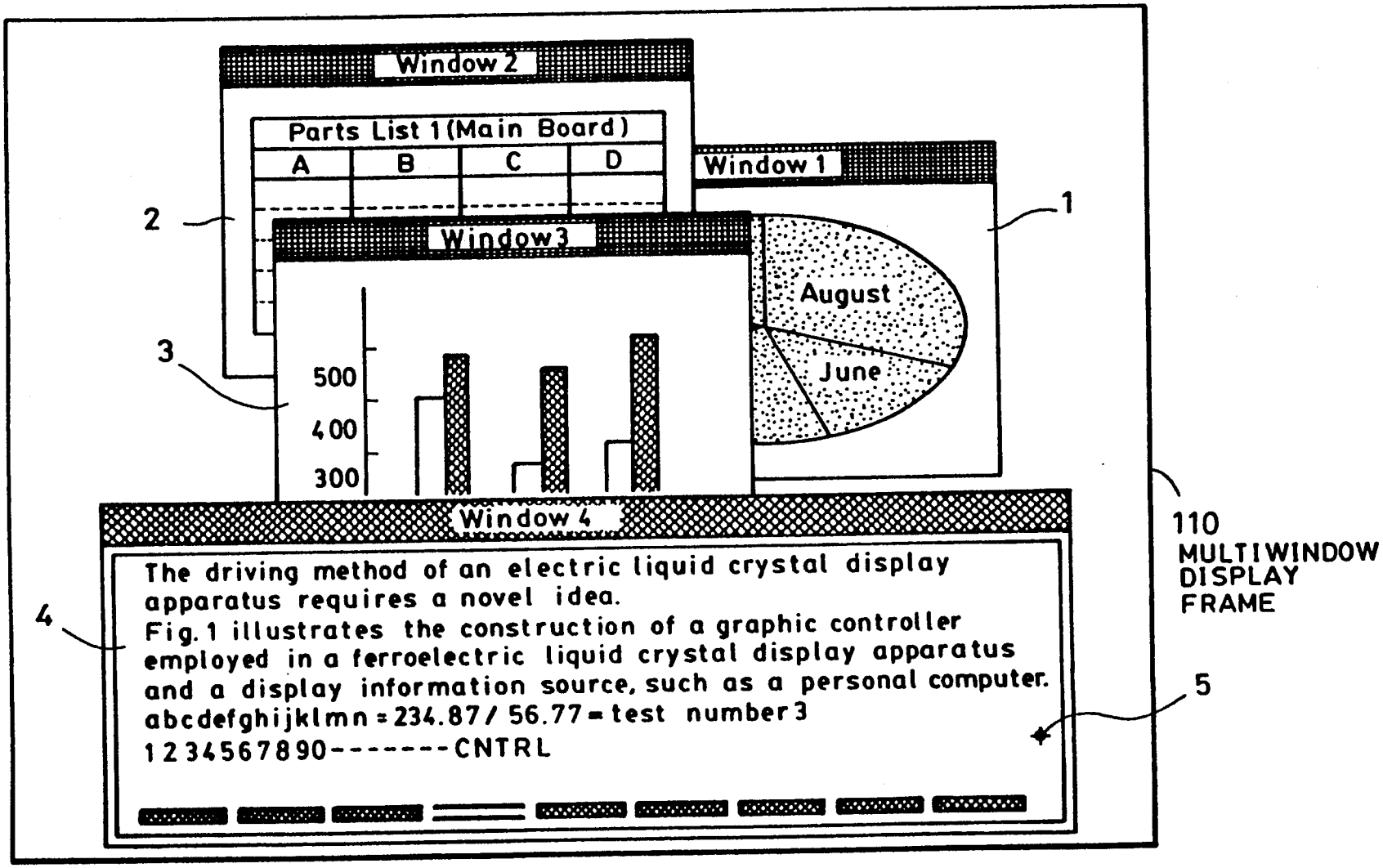
FIG. 11 illustrates a display frame of a multi-window display according to the present invention.

FIG. 11 shows an example of a multiwindow display frame 110 according to the present invention. A window 1 displays a circle graph exhibiting the result of a certain survey. A window 2 displays a table showing the same result exhibited by the circle graph in the window 1. A window 3 displays a bar graph exhibiting the same result as above. A window 4 displays a document being written and an icon of the mouse, i.e. the pointing device, 5.

In the figure, let it be supposed that the windows 1 to 3 are non-active and that while scrolling is being performed in the window 4 to edit the document, the mouse 5 is moved. Both scrolling and mouse movement requires partial rewriting in the ferroelectric liquid crystal display apparatus 101. If 1120 scanning lines of the entire frame are scanned, the frame frequency will be about 10 Hz since one horizontal scanning period is 80 μsec according to this embodiment. This frame frequency is not fast enough to follow the normal movement of the mouse 5 (≧30 Hz).

If the partial rewriting method shown in FIG. 9 is used in this case, the scrolling in the window 4 and the movement of the mouse 5 correspond to the first and second partial rewriting routines, respectively. In the first partial rewriting routine, scanning methods are changed from multi-interlace scanning for the entire frame refresh routine to non-interlace scanning in order to perform partial rewriting in the window 4. Non-interlace scanning is required because the display operation for scrolling in a window requires the ferroelectric liquid crystal display apparatus 101 to quickly change its display and because what is displayed (e.g., characters) must be recognizable during scrolling. If, like page turning, the process of rewriting in the window 4 does not need to be recognizable, a change of scanning methods is not required. In such a case, multi-interlace scanning provides a more stable picture quality than non-interlace scanning. Branching to the second partial rewriting routine occurs when the mouse 5 is moved. The time required for the branching is one horizontal scanning period at most. Since the moving process of the mouse 5 must be traced as in the scrolling in the window 4, the scanning method for this partial rewriting must be the non-interlace scanning. If the font size of the mouse 5 is 32×32 dots and one horizontal scanning period is 80 μsec, the time required to write the mouse 5 in the display panel is $$32 \times 82\ \mu\text{sec} = 2.56\ \text{msec}$$

Although, for this duration of 2.56 msec, the scrolling operation in the window 4 performed by the first partial rewriting routine is stopped, the duration is very short and, therefore, does not significantly affect the scrolling speed. After the mouse 5 is rewritten in, processing returns to the first partial rewriting routine in the window 4. However, another mouse movement causes immediate branching to the partial rewriting for the mouse 5, in which the mouse 5 is rewritten by the non-interlace scanning. When the first and second partial rewriting routines are completed, processing returns to the entire refresh routine.

When there is no display change in a window or no movement of the mouse, the window and the mouse are displayed by multi-interlace refresh scanning. If partial rewriting is so performed for predetermined display operations by selecting the appropriate scanning method, the sufficiently fast movement of the mouse and the sufficient display quality of the moving mouse can be achieved even in the low frame-frequency driving unique to ferroelectric liquid crystal display apparatuses.

The preferred embodiment of the present invention includes means for changing scanning methods according to image data for which partial rewriting is performed. If such image data causes slow display change, multi-interlace scanning is performed in order to maintain picture quality. If such image data causes fast change and requires display of the moving process, such as movement of a mouse or scrolling in a window, non-interlace scanning is performed. Thus, the embodiment achieves a method suitable for a variety of applications which require the ferroelectric liquid crystal display apparatus to perform partial rewriting and, thereby, smoothly displays sophisticated display application software, such as multiwindow and multitask applications, without causing any problems.

Figure 5:
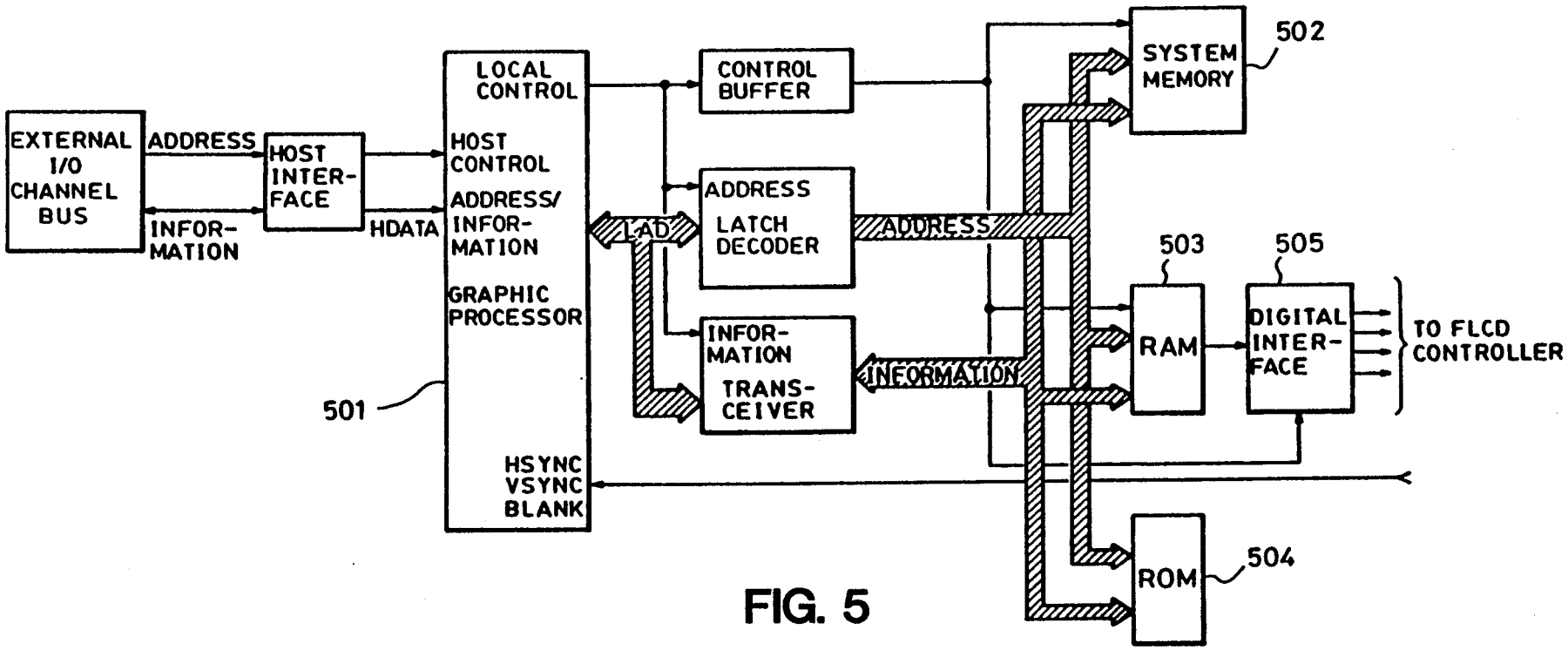
FIG. 5 is a block diagram of a graphic controller used in the present invention.
Figure 6:
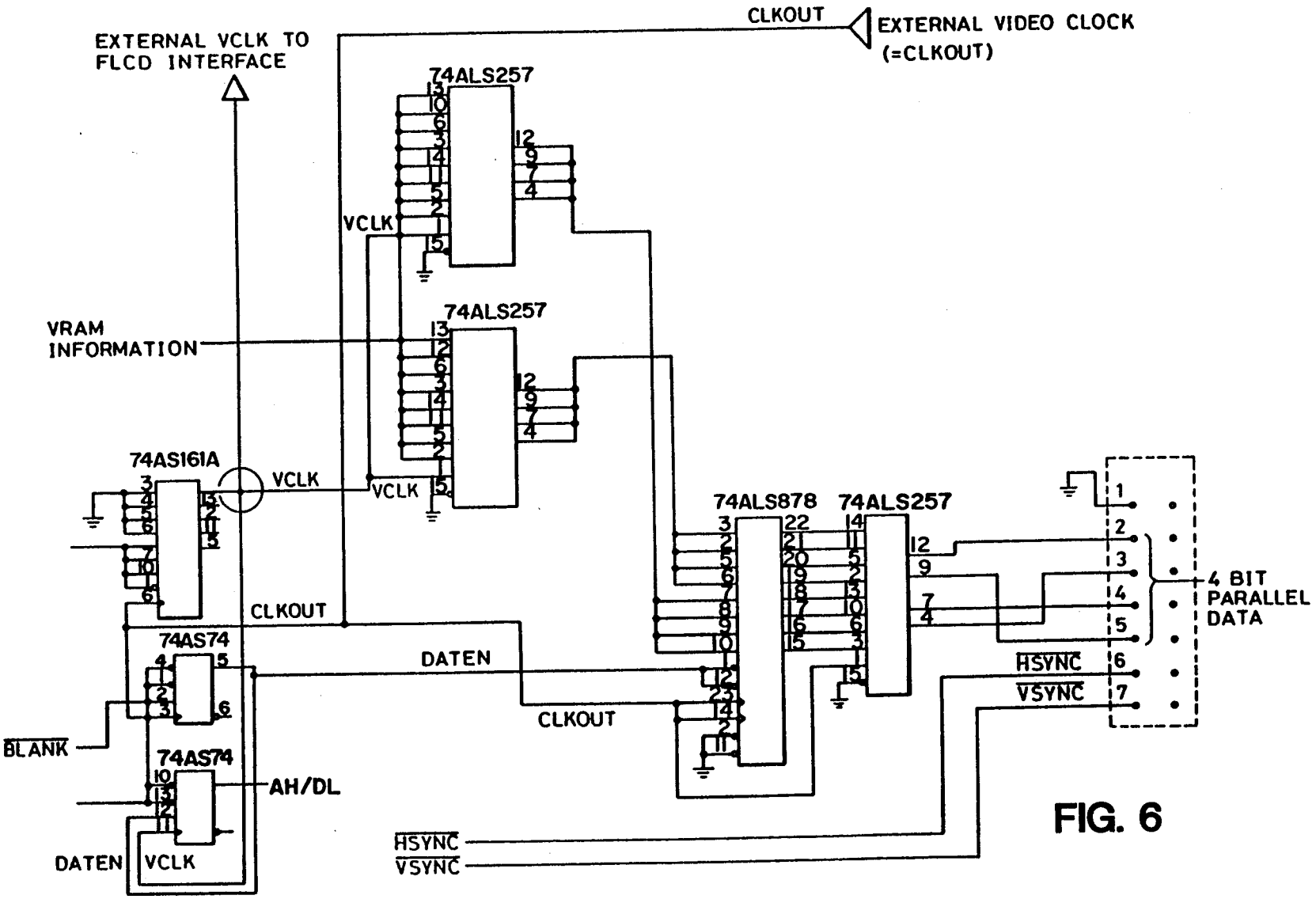
FIG. 6 is a block diagram of a digital interface.
Figure 7:
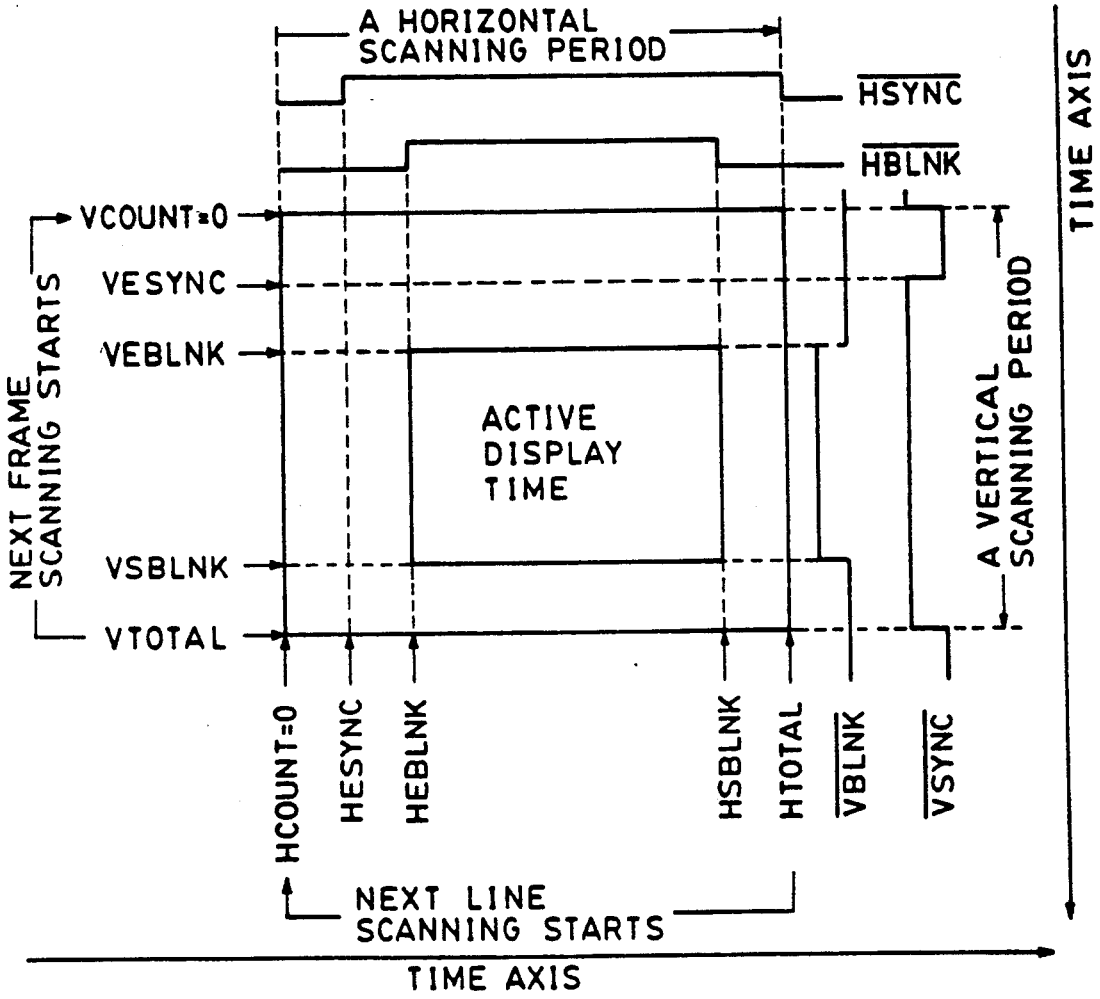
FIG. 7 is an interface timing chart for a display driving apparatus used in the present invention.
Figure 8:
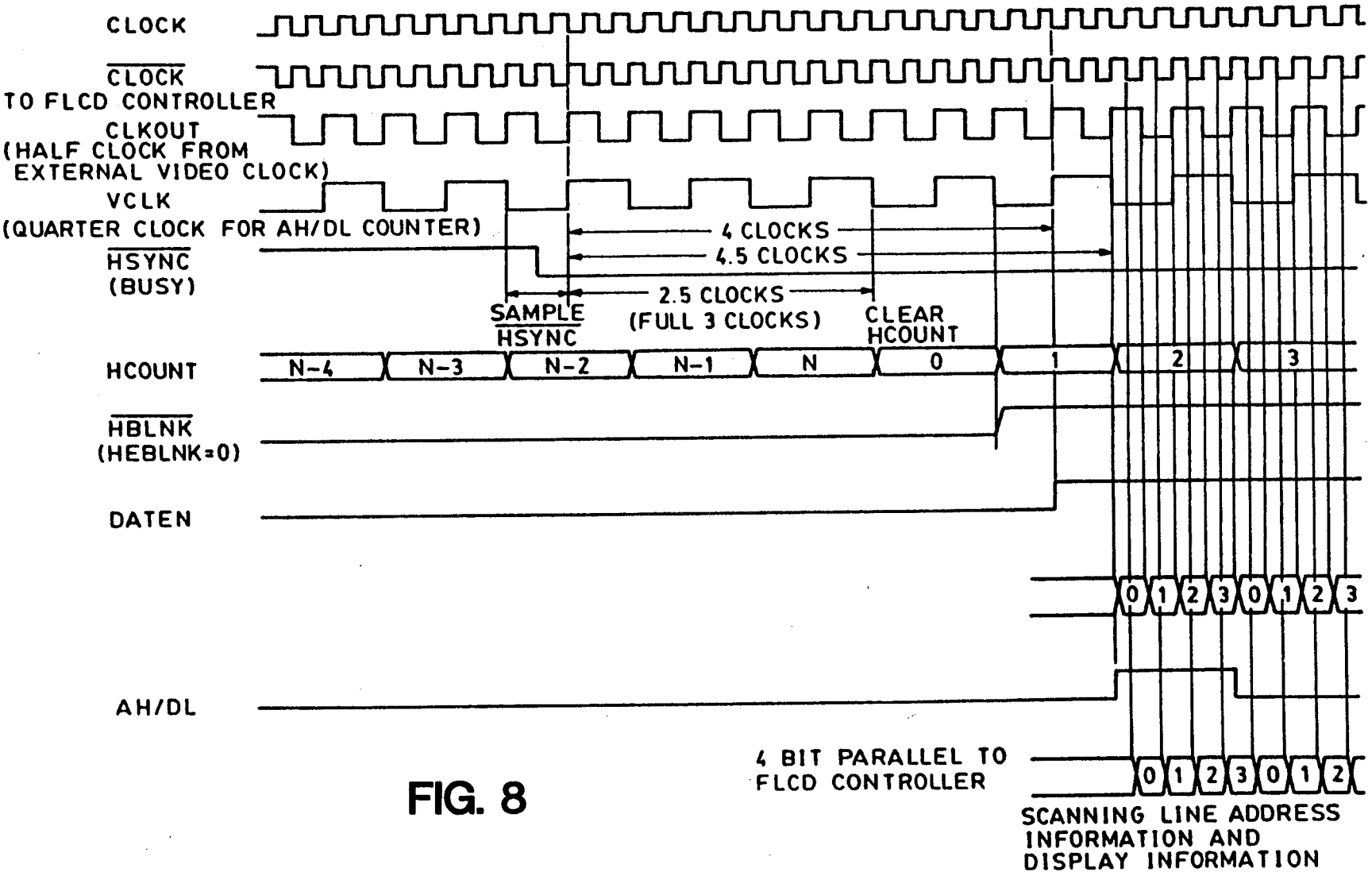
FIG. 8 is an interface timing chart for an FLCD controller.

FIG. 5 is a block diagram of the graphic controller 102. FIG. 6 is a block diagram of a digital interface 505 of FIG. 5. FIGS. 7 and 8 are timing charts of data transfer.

The graphic controller 102 according to the present invention is substantially different from conventional graphic controllers in the following features. As shown in FIG. 5, a graphic processor 501 has its own system memory 502. The graphic processor 501 not only manages a RAM 503 and a ROM 504 but also executes and manages description commands to the RAM 503. Further, information transfer from a digital interface 505 to the FLCD controller, management of methods of driving the FLCD, etc., can be programmed independently.

Referring to FIG. 6, while the digital interface 505 is performing synchronization with the driving circuits 104 and 105 of the display panel 103 using external synchronizing signals $\overline{\text{HSYNC}}$ and $\overline{\text{VSYNC}}$ from the FLCD controller 111, the data from the VRAM becomes 4 bits/clock (data transfer clock) at the final stage of the processing by the digital interface 505 and is sent to the FLCD controller 111. FIG. 7 shows the timing for the FLCD to perform entire frame rewriting. Parameters used in FIG. 7 are the same as those in FIG. 8. Transfer of one line of image data starts when the $\overline{\text{HSYNC}}$ signal becomes active (low level). The $\overline{\text{HSYNC}}$ signal is made low by the FLCD controller 111 to indicate an information request made by the display panel 103. The information request made by the display panel 103 is received by the graphic processor 501 show in FIG. 5 and processed therein at the timing shown in FIG. 8. According to the timing chart shown in FIG. 8, the $\overline{\text{HSYNC}}$ signal of the information request made by the display panel 103 for one cycle of an external video clock from the outside (CLKOUT) (in other words, for a period of low level of VCLK) is sampled (actually, the VCLK is inputted to the graphic processor 501, which performs such sampling for the period of low level of the VCLK). Two and half clocks of the VCLK after such sampling, a horizontal counter HCOUNT in the graphic processor 501 is cleared. Then, $\overline{\text{HBLNK}}$ signal becomes disabled (high) just before the horizontal counter becomes 1 (HCOUNT =1) by programming parameters HESYNC and HEBLNK. In the circuit shown in FIG. 6, a DATEN becomes active (high) half a clock of the VCLK after the $\overline{\text{HBLNK}}$ signal becomes disabled, as shown in FIG. 8. Half a clock later, i.e., 4.5 clocks after the sampling of the $\overline{\text{HSYNC}}$ signal, the image data of the next line is transferred, four bits at a time, from the VRAM to FLCD controller 111.

AS shown in the bottom-right portion of FIG. 8, first, the scanning line address information of the next line (corresponding to the scanning line numbers) is sent out four bits at a time, and then, the display information of this line is sent out. The FLCD controller 111 discriminates the scanning line address information and the display information by using the AH/DL signal. The high level of the AH/DL signal indicates scanning line address information, and the low level of the AH/DL signal indicates display information. A scanning line of the FLCD 101 is selected according to scanning line address information, and display information is written into the selected scanning line. Therefore, if the scanning line address information continuously transferred from the graphic controller 102 indicates scanning line numbers which serially increase one by one, the FLCD 101 is driven by non-interlace scanning. If such scanning line address information indicates scanning line numbers which increase by two, the FLCD 101 is driven by the interlace scanning. If such scanning line address information indicates scanning line numbers which increase by m, the FLCD is driven by m-multi-interlace scanning. The graphic controller 102 thus controls driving methods in the FLCD.

The time required to drive one scanning line of the FLCD is about 100 μsec. If the driving time for one scanning line is 100 μsec, and the lowest possible frequency which causes no flickering is 30 Hz, the following number of scanning lines of the FLCD can be driven without causing flickering in a static image:

by non-interlace driving

[Calculation 3] (1/30 Hz)/100 μsec=333 (lines)

by interlace driving

[Calculation 4] (1/30 Hz)×2/100 μsec=666 (lines)

by m-multi-interlace driving

[Calculation 5] (1/30 Hz)×m/100 μsec=333×m (lines)

The experiments show that if m=32, flickering still does not occur. Theoretically, a display panel having the following number of scanning lines can be driven without causing flickering

[Calculation 6] (1/30 Hz)×32/100 μsec=333×32=10656 (lines)

As the number indicates, a flat display panel much superior in minute display to conventional flat display panels can be provided.

In the digital interface of FIG. 6, 74AS161A, 74AS74, 74ALS257, and 74ALS878 are IC Nos., and the other numerals are pin Nos. The integrated circuits in FIG. 6, listed above, are also known in the industry by their Texas Instruments, Inc. trade names: SN74AS161, SN74AS74, SN74ALS257, and SN74ALS878, respectively.

Figure 12:
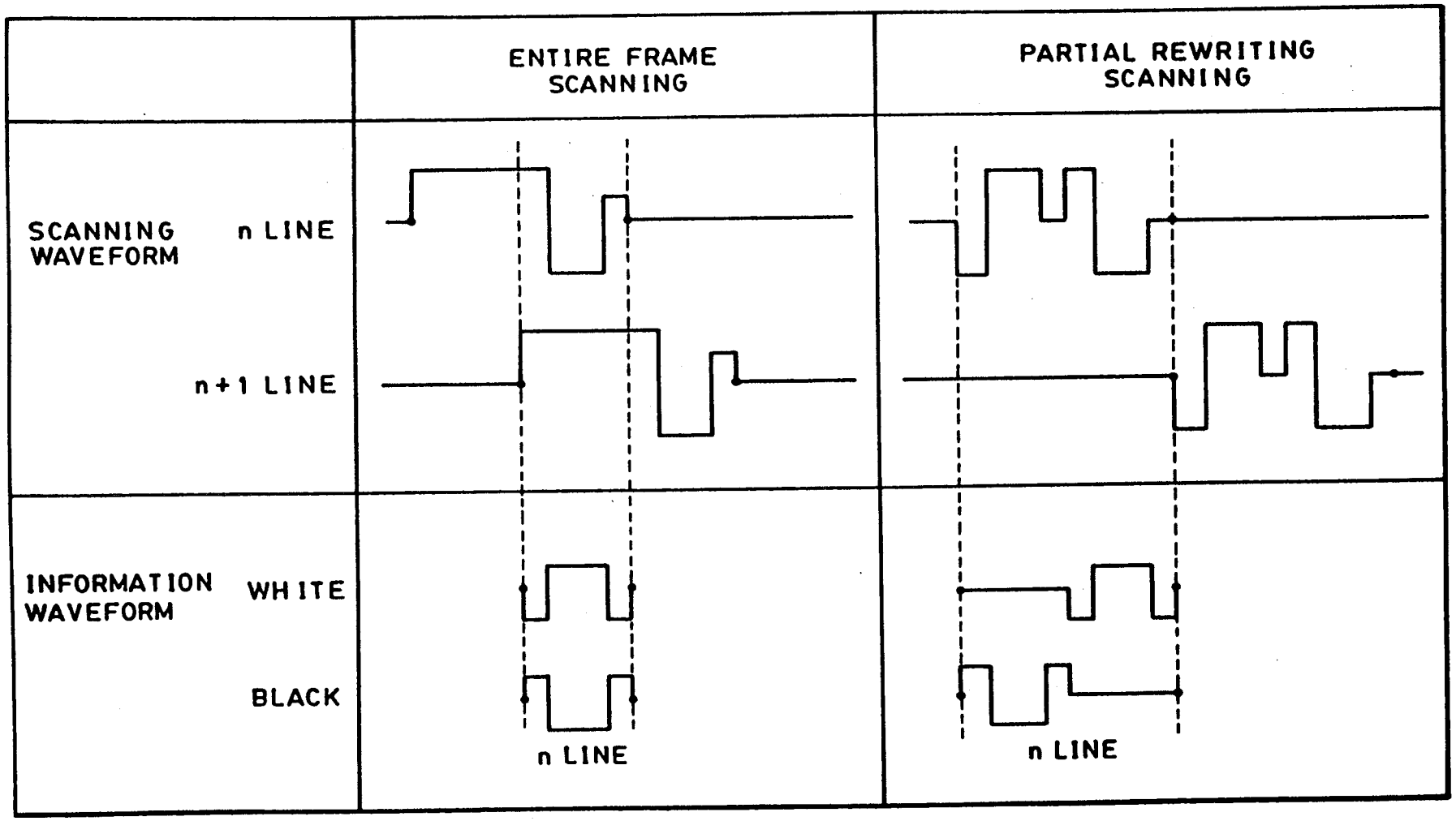
FIG. 12 illustrates driving waveforms used in the present invention.

FIG. 12 shows driving waveforms according to one embodiment of the present invention. During entire frame scanning, waveforms which include black erasing pulses and DC components and which drive two neighboring scanning lines at a time (double driving) are used. During partial rewriting scanning, waveforms which include no erasing pulses and no DC components and which drive one scanning line at a time (single driving) are used.

Figure 13:
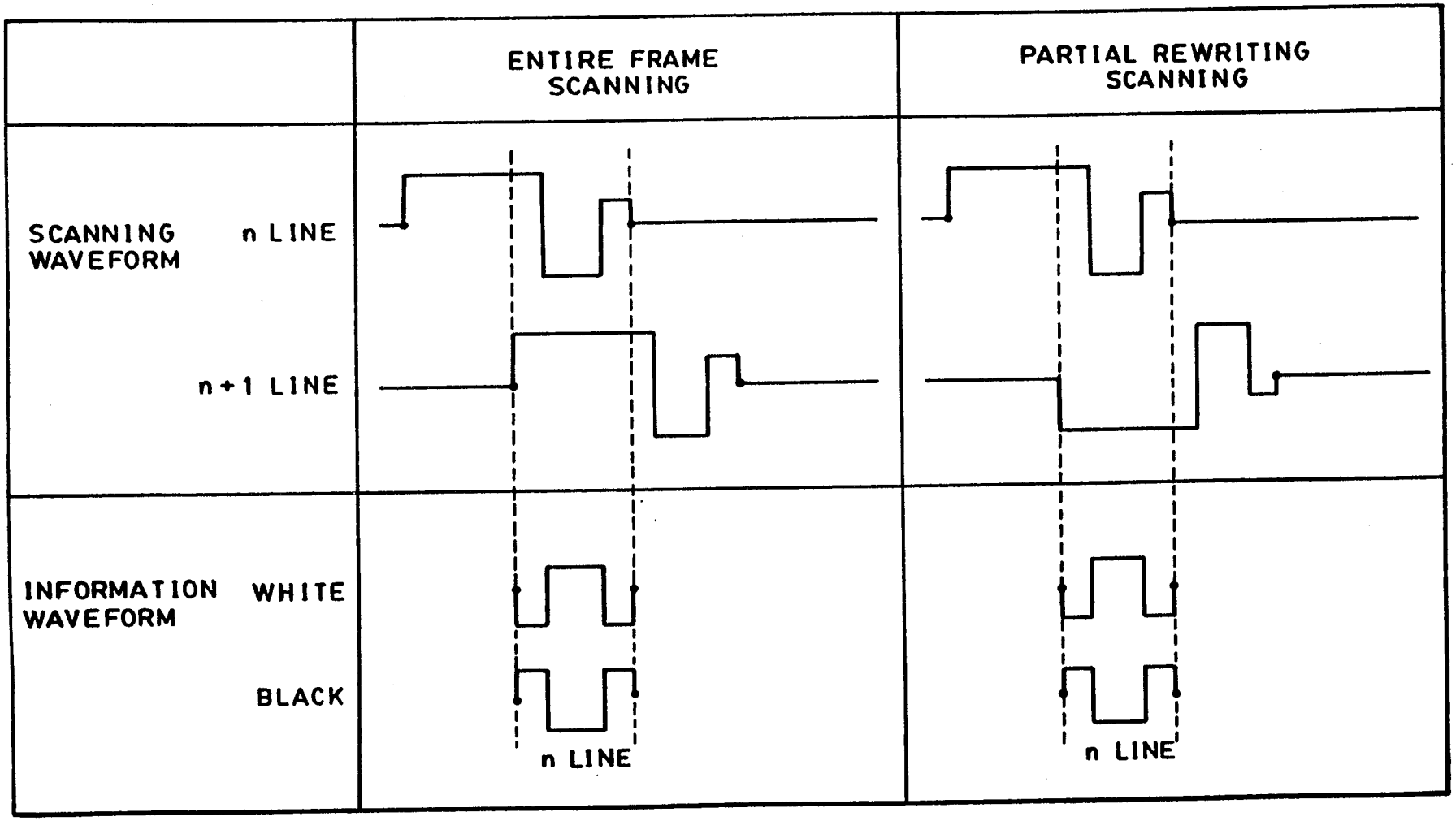
FIG. 13 illustrates other driving waveforms used in the present invention.

FIG. 13 shows driving waveforms according to another embodiment of the present invention. During entire frame scanning, waveforms including black erasing pulses and DC components are used. During partial rewriting scanning, waveforms including black erasing pulses and waveforms including white erasing pulses are alternately used. Neither of the waveforms includes a DC component.

Figure 14:
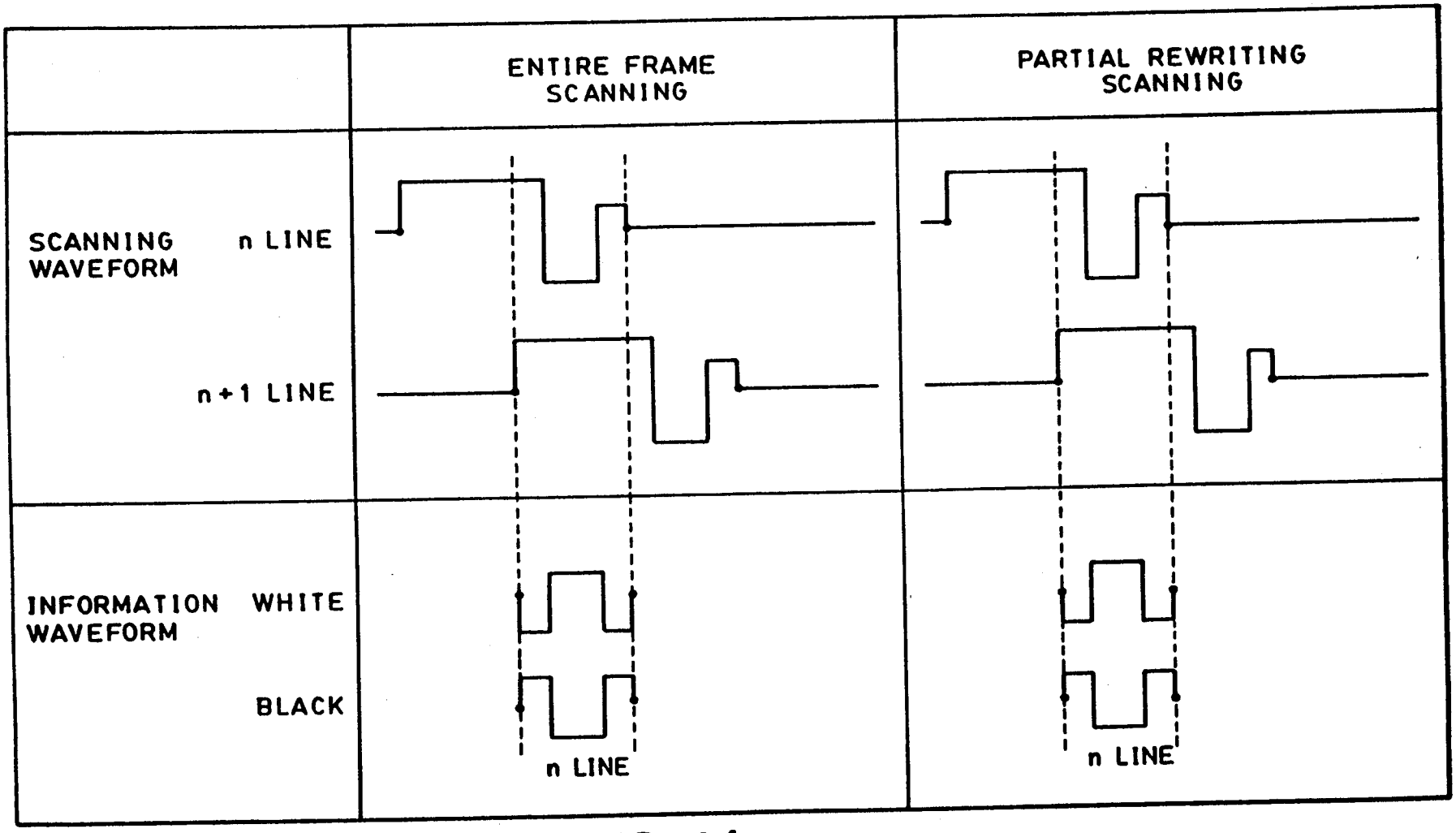
FIG. 14 PRIOR ART
FIG. 14 illustrates conventional driving waveforms.

FIG. 14 shows conventional driving waveforms. The same waveforms are used both during entire frame scanning and during partial rewriting scanning.

Table 3 below shows a comparison between the driving waveforms for the partial rewriting scannings according to the embodiments, shown in FIGS. 12 and 13, and the partial rewriting scanning of the conventional art, shown in FIG. 14. Because the driving waveforms according to the embodiments include no DC components, they cause less deterioration in the liquid crystal alignment than the conventional driving waveform and fairly expand driving margins. Because the driving waveforms according to the embodiments do not include black erasing pulses or include both black and white erasing pulses to offset each other, they cause less decrease in contrast.

Frequent repetition of the driving of a scanning electrode, which may well happen in partial rewriting, lowers the threshold of the pixels on the scanning electrode. However, according to the present invention, the amplitude or the writing pulse width during partial rewriting scanning is reduced by a predetermined percentage from the value thereof during entire frame scanning. Therefore, driving substantially at the center of the driving margin can be achieved in any of the scanning methods.

TABLE 3

| | Conventional | Embodiment 1 | Embodiment 2 |
|---|---|---|---|
| Driving Margin | Δ | Δ | ○ |
| Alignment | X | ○ | ○ |
| Contrast | Δ | ○ | ○ |

Figure 15:
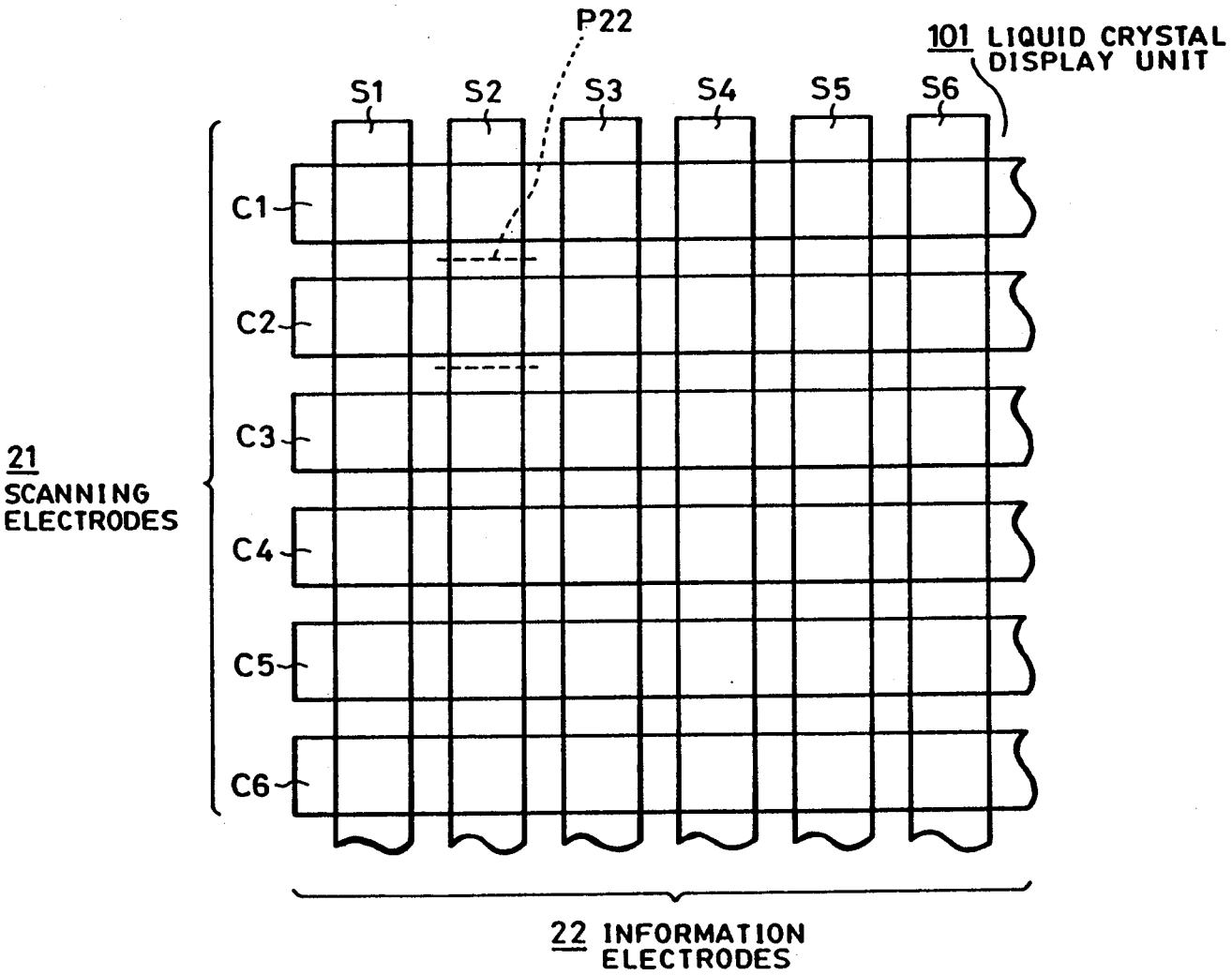
FIG. 15 is a plan view of a display panel.

FIG. 15 is an enlarged view of the display panel 103. Scanning electrodes C1 to C6 and information electrodes S1 to S6 are arranged in a matrix and form pixels P22 which are the units of display.

Figure 16:
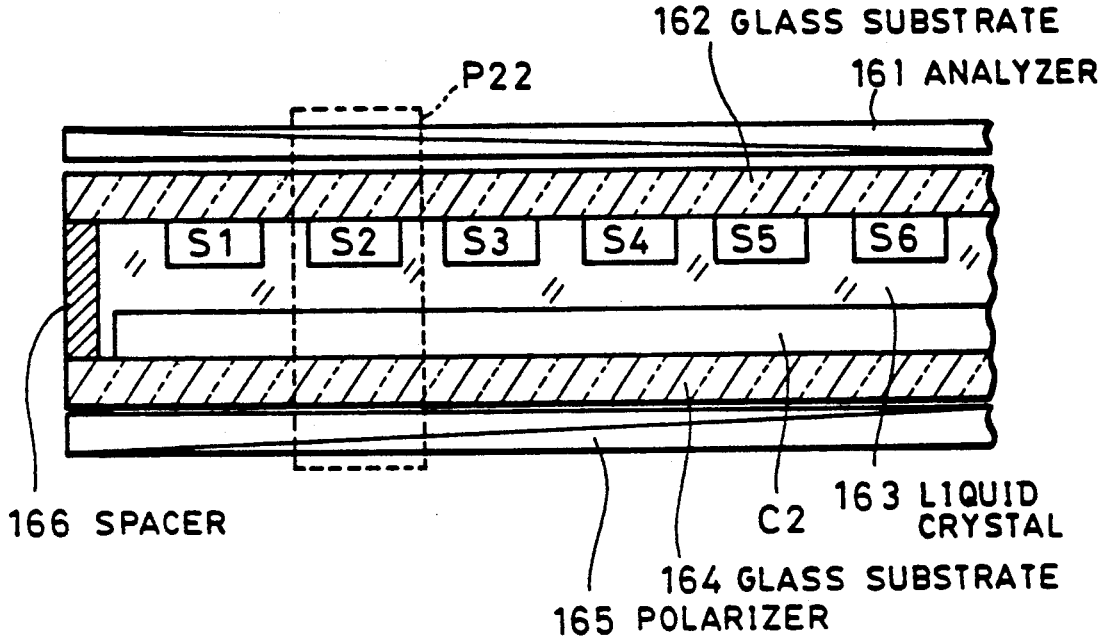
FIG. 16 is a sectional view of the display panel shown in FIG. 15.

FIG. 16 is a sectional view of the display panel 103 including the scanning line C2 shown in FIG. 15. The figure shows an analyzer 161, a polarizer 165, glass substrates 162 and 164, ferroelectric liquid crystal 163 and a spacer 166. The analyzer 161 and the polarizer 165 are arranged in crossed nicol.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A display apparatus comprising:

a matrix of electrodes including scanning electrodes and information electrodes;

driving means for scanning said matrix so as to apply a selected driving waveform comprising driving signals to selected ones of said scanning electrodes, and to apply data signals in synchronism with the driving signals to said information electrodes in parallel; and control means for controlling said driving means so as to perform, in response to a graphic event to be displayed, either an entire frame scanning in which said matrix is fully rewritten or a partial rewritting scanning in which said matri is partially rewritten, wherein a driving waveform selected for said entire frame scanning is different from a driving waveform selected for said partial rewriting scanning.

2. A display apparatus according to claim 1, further comprising a liquid crystal provided between said scanning electrodes and said information electrodes.

3. A display apparatus according to claim 2, wherein said liquid crystal is a ferroelectric liquid crystal.

4. A display apparatus according to claim 1, wherein during performance of said entire frame scanning, said driving means uses a driving waveform including an erasing pulse and a writing pulse, and during performance of said partial rewriting scanning, said driving means uses a driving waveform including no erasing pulse.

5. A display apparatus according to claim 1, wherein during performance of said entire frame scanning, said driving means performs double driving in which a driving waveform including an erasing pulse and a writing pulse is used to scan two scanning electrodes at a time so that said erasing pulse is applied to one of the two scanning electrodes and said writing pulse is applied to the other scanning electrode, and wherein during performance of said partial rewriting scanning, said driving means performs single driving in which a driving waveform is used to scan one scanning electrode at a time.

6. A display apparatus according to claim 1, wherein during performance of said entire frame scanning, said driving means uses a driving waveform including an erasing pulse and a writing pulse, and during performance of said partial rewriting scanning, said driving means alternately uses a driving waveform including a black erasing pulse and a writing pulse and a driving waveform including a white erasing pulse and a writing pulse.

7. A display apparatus according to claim 1, wherein said driving means uses driving voltages or driving voltage ratios during performance of said entire frame scanning different from driving voltages or driving voltage ratios used during performance of said partial rewriting scanning.

8. A display apparatus according to claim 1, wherein said driving means uses driving signals and data signals during performance of said entire frame scanning having different durations from those of driving signals and data signals during performance of said partial rewriting scanning.

9. A display apparatus according to claim 1, wherein during performance of said entire frame scanning, said driving means uses a driving waveform including a DC component, and during performance of said partial rewriting scanning, said driving means uses a driving waveform including no DC component.

* * * * *

UNITED STATES PATENT AND TRADEMARK OFFICE

CERTIFICATE OF CORRECTION

PATENT NO. : 5,321,419

DATED : June 14, 1994

INVENTOR(S) : KAZUNORI KATAKURA, ET AL.

It is certified that error appears in the above-identified patent and that said Letters Patent is hereby corrected as shown below:

COLUMN 3

Line 56, "and" should read --and ¶ display request 38 for scanning the entire display.--.

COLUMN 8

Line 64, "requires" should read --require--.

COLUMN 10

Line 32, "show" should read --shown--.

COLUMN 12

Line 58, "matri" should read --matrix--.

Signed and Sealed this

Eighteenth Day of April, 1995

Bruce Lehman

*Attest:*

BRUCE LEHMAN

*Commissioner of Patents and Trademarks*

*Attesting Officer*